United States Patent [19]

Van Pelt

[11] Patent Number: 4,751,879

[45] Date of Patent: Jun. 21, 1988

[54] METHOD AND APPARATUS FOR INTERMITTENTLY PROCESSING SUCCESSIVE DEFINITE LENGTHS OF A CONTINUOUS FLEXIBLE WEB

[75] Inventor: Christopher K. Van Pelt, Nokomis, Fla.

[73] Assignee: Van Pelt Equipment Corporation, Nokomis, Fla.

[21] Appl. No.: 27,443

[22] Filed: Mar. 18, 1987

[51] Int. Cl.[4] ..... B41F 13/54

[52] U.S. Cl. ..... 101/228; 226/8; 226/143; 493/411

[58] Field of Search ..... 101/219, 222, 223, 225, 101/228, 230, 132, 138; 226/8, 10, 24, 33, 35, 38–39, 49, 120, 123, 140, 141, 143, 146, 147, 158, 195; 493/409–411

[56] References Cited

U.S. PATENT DOCUMENTS

| | | | |
|---|---|---|---|
| 1,454,822 | 5/1923 | Sherman . | |
| 2,039,236 | 4/1936 | Meisel | 101/128 |
| 2,999,456 | 9/1961 | Lanegan | 101/228 |
| 3,244,095 | 4/1966 | Matthew | 101/94 |
| 3,371,834 | 3/1968 | Willits et al. | 226/143 X |
| 3,401,630 | 9/1968 | Goodrich, Jr. et al. | 101/228 |
| 3,548,747 | 12/1970 | D'Amato | 101/228 X |
| 3,645,203 | 2/1972 | Slavic | 101/228 |
| 3,756,149 | 9/1973 | Bishop | 226/143 |
| 3,797,389 | 3/1974 | Wolff | 101/178 |
| 3,977,586 | 8/1976 | Hertrich | 226/143 X |
| 4,043,440 | 8/1977 | Busch | 101/228 |
| 4,060,187 | 11/1977 | Grob | 226/8 |
| 4,175,687 | 11/1979 | Kenworthy | 226/143 |
| 4,205,770 | 6/1980 | Wojdyla | 101/228 X |
| 4,372,206 | 2/1983 | Tison et al. | 101/228 |
| 4,401,250 | 8/1983 | Carlsson | 226/33 |
| 4,416,200 | 11/1983 | Yon | 101/228 |
| 4,545,518 | 10/1985 | Bergland | 101/228 X |

*Primary Examiner*—Eugene H. Eickholt

*Attorney, Agent, or Firm*—Albert C. Johnston

[57] ABSTRACT

A system is provided for intermittently processing successive definite lengths of flexible sheet material in continuous web form, e.g., tractor-fed computer printout paper, with nearly tensionless transport of the web through web feeding operations, cyclical web processing and driving operations, and web delivery operations, that are not speed-interdependent. For each processing cycle, with the web extended without slack through an upstream lead to a processing station where a certain length of the web is positioned to be next processed, an excess length of loose web is fed into that lead, typically forming a loop in it; then the certain web length is processed and driven forward a distance shorter than the length of loose web; and then web is retracted from the upstream lead to remove the residual loose web and leave a next certain web length in position to be processed. The processed web is delivered and may be folded into a pack as a downstream lead of it is made slack by web driven from the processing station. The system enables increased speeds of offset printing of paper such as continuous computer printout forms.

28 Claims, 4 Drawing Sheets

Figure 1:
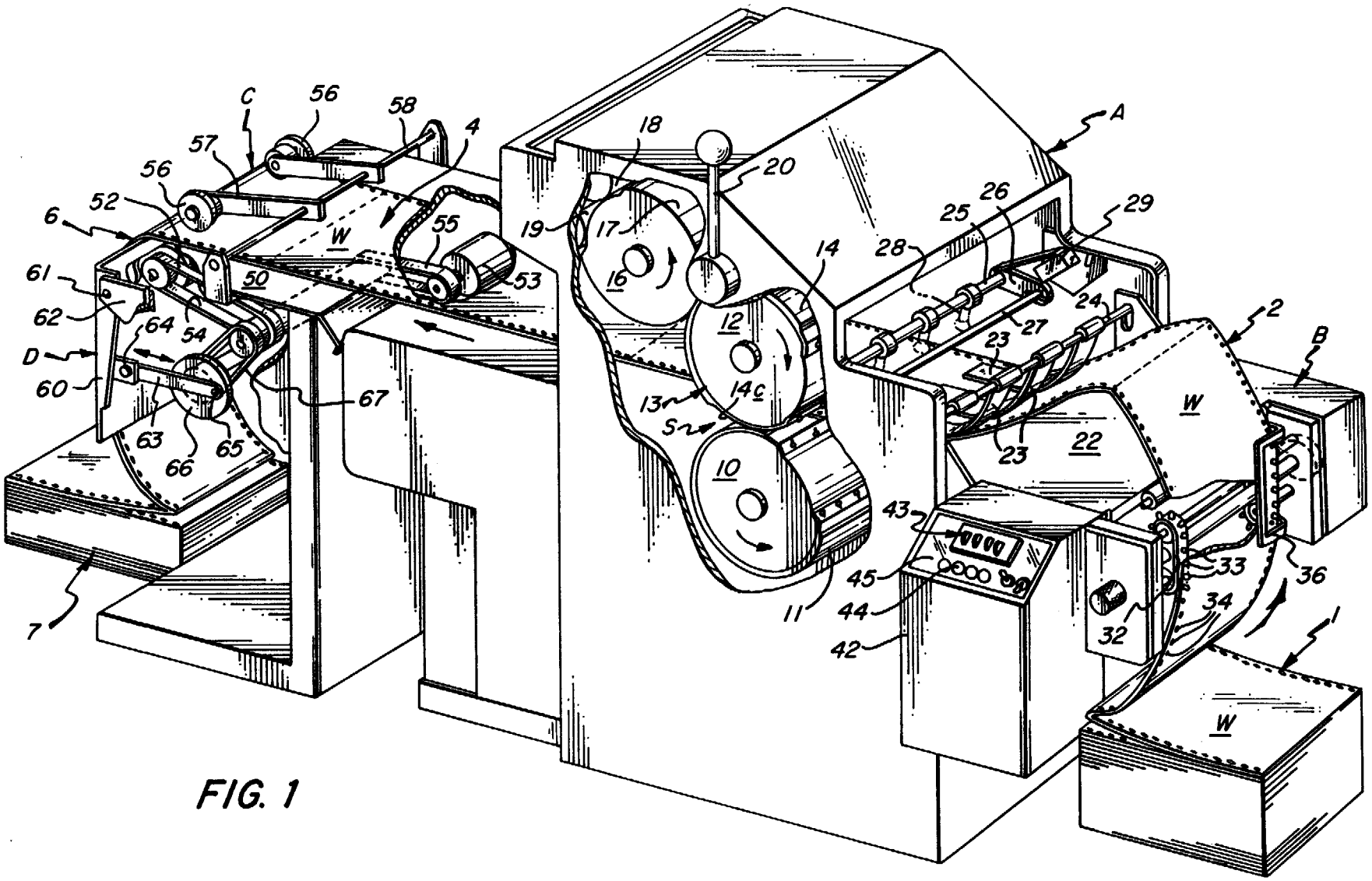

METHOD AND APPARATUS FOR INTERMITTENTLY PROCESSING SUCCESSIVE DEFINITE LENGTHS OF A CONTINUOUS FLEXIBLE WEB

This invention relates to a method and apparatus for processing one after another, as in a printing or other machine capable of repetitively processing individual sheets, definite lengths of a flexible sheet material fed to the machine in continuous web form. More particularly, the invention relates to a method and apparatus by which a conventional sheet fed printing press, such as an offset duplicator for printing and driving forward paper sheets one after another by rotations of coacting image transfer and impression cylinders, can be adapted economically for efficient operation to print successive definite lengths of a continuous web. These web lengths, for example, may be the sheet sections or "forms" between fold lines of a computer printout paper or the like fed to the press from a zig-zag folded pack of the paper.

Several systems are known which make use of such an offset duplicator modified so as to run on paper in continuous form instead of individual sheets. In some cases, sheet fed presses are modified by the attachment of conversion units which make them serve for printing successive equal lengths of a continuous web, such as the sheet sections between fold lines of computer printout paper.

The known systems, however, present problems. One problem is that they involve objectionably complex and costly arrangements and control systems for synchronizing the feeding of the web with the operations of intermittently processing and driving forward lengths of the web at the processing station. A related problem is that time-consuming adjustments are required in order to adapt the mechanisms and their controls for a change of the length of the web sections to be processed in the press operations.

Another important problem of the known systems is press speed. A sheet fed offset press will usually run, for example, about six to eight thousand impressions per hour. A similar press modified or made for processing a continuous web will usually run, for example, only about four to five thousand impressions per hour. The reason for the lower speed is two-fold: First, timing (sequencing) errors with resultant stresses on the web occur readily in the mechanical synchronization of the web feeding and web processing functions. Second, the rapid stops and resumptions of driving action on the web by the press cylinders cause inertial and tension loads on the web extending from the web feeder or a web supply to the processing station. Either or both of these factors at high press speeds may cause a paper web to break or tear and thus stop production. This problem is especially severe in the processing of continuous computer printout paper, due to the web being easy to tear along the transverse fold or score lines between its successive sections.

It accordingly has been desirable, and is a principal object of the present invention, to provide a system by which, in conjunction with operations for intermittently processing and driving forward successive definite lengths of a flexible sheet material at a processing station, the sheet material is fed, processed and driven forward in continuous web form yet stresses on the web are avoided so that the speed of the operations can be increased and/or relatively weak or fragile web materials can be processed efficiently, without breakage or tearing of the web.

Another important object of the invention is to provide such a system by which the length of the web sections to be processed in successive cycles of the operations can be changed easily without requiring alteration of the apparatus or resettings of controls at the processing station.

A further object is to provide a method and an apparatus for intermittently processing and driving forward successive definite lengths of flexible sheet material in continuous web form, by virtue of which the speed of the feeding of the web from a supply thereof toward the processing station is independent of the speed with which the processing and driving forward operations are performed there.

According to the present invention, successive definite lengths of a flexible sheet material in continuous web form are intermittently processed and driven forward at a processing station, such, for example, as that provided between an impression cylinder and a coacting image transfer or blanket cylinder of a rotary offset press of the kind usual for printing individually fed paper sheets, by a method which comprises: (a) feeding into a lead of the web upstream from the processing station an excess length of the web longer than a certain web length positioned to be processed in the station, thus forming a loose loop of the web; (b) then processing the certain web length and driving forward from the station and out of the upstream lead a length of the web at least as long as the certain web length but shorter than the excess web length, thus leaving slack web in the upstream lead; (c) then drawing the web backward from that lead so as to retract the slack web therefrom and leave positioned in the processing station a next certain web length to be processed; and then repeating steps (a), (b) and (c).

By virtue of this method, there is never any objectionable stress or tension on the web leading into the processing station; the risk of the web breaking or being torn is greatly reduced; and the speed of the operations at the processing station can be substantially increased.

Further, there is no need to match the speed of feeding the web into the upstream lead to the speed of the operations at the processing station, as the web feeding is effected in a phase of each operating cycle during which the web is not being driven forward at the processing station.

Still further, a simple adjustment of the extent of the web retraction in that phase of the cycle can serve for determining or changing the certain web length next to be processed. This advantage is achieved because the length of the web drawn backward after the processing phase of a cycle corresponds to the difference between the excess web length then fed into the upstream web lead and the certain web length to be processed out of that excess. For instance, if in each cycle an excess web length of 14¾ inch is fed into the upstream lead, the length of web drawn backward after the operations at the processing station will be 3¾" if the net processed web length is 11 inches, ¾" if that length is 14 inches, or 7¾" if that length is 7 inches.

In another manner of application of the invention, the speed of the operations can be enhanced further by limiting the excess web length fed into the upstream lead and the length of web driven forward from the processing station in each cycle to little more than the length of identical web portions that are to be processed successively. For instance, successive web lengths of 11 inches each can be processed with, for example, 11¾ inches of excess web fed into the upstream lead and 11¼ inches of web driven forward in each cycle. The corresponding draw back of web then is ¾" in length. The cycles can then be faster because surplus distances of movements of the web are avoided. For this manner of use of the invention, a change of the length of the identical web portions to be processed can be accomplished by correspondingly changing the length of excess web fed into the upstream lead and the distance of forward drive of the web from the processing station.

According to another aspect of the invention, an apparatus is provided for processing successive definite lengths of a continuous flexible web extended from a supply of the web through a processing station at which continuously cyclically operable web processing and web driving means do not operatively engage the web in one phase of their cycle and in a second phase of the cycle will process a certain length of the web, drive the web forward a certain distance at least as long as the certain web length, and then disengage from the web.

In the apparatus of this invention, a web feeding means is provided which non-slippably engages the web at a location spaced upstream from the processing station and is operable periodically to draw a measured length of web backward from the web lead extending from the feeding means into the station, and then to feed into that lead a measured excess length of web longer than the distance of forward drive of the certain web length from the processing station.

Further, means are provided for activating and controlling the web feeding means in the one phase of each operating cycle so that the web first is drawn backward to remove slack from the upstream web lead and leave a certain web length positioned to be processed in the processing station and then is fed forward in excess so that the driving forward of the certain web length in the second phase of the cycle will leave the web slack in the upstream lead.

Such an apparatus in operation will carry out and achieve the advantages of the described method. The apparatus can be provided either by being incorporated in a printing or other web processing machine designed for purposes of the invention or by relatively simple adaptation or conversion of an existing machine such, for example, as a conventional sheet fed offset printing press.

In a preferred embodiment of the invention, the web feeding means comprises web drive means such, for example, as a tractor drive having pins engaged in perforations formed along strips at opposite sides of the web, with a reversible stepper motor connected for driving the web drive means. The stepper motor operations are controlled via control means which are easily adjustable to set precisely the respective distances of the drawing backward and the feeding forward of the web in each period of activation of the motor. The activation of the web feeding means is effected through suitable switch means moved in coordination with each cycle of the operations at the processing station. In the case of conversion of an existing sheet fed press into an apparatus of the invention, the rocking "sucker bar" usual for feeding sheets into the press can be employed conveniently, with the sheet suckers removed, for opening and closing a micro switch through which the web feeding means is activated in the said one phase of each operating cycle of the press.

According to another feature of the invention, the apparatus comprises means for exerting constantly on the upstream web lead at a location near the processing station a friction sufficient to resist displacement of the web there otherwise than by the web processing and driving means or the web feeding means. For this purpose, conveniently, the apparatus can include a support over which the web is slidable to the processing station, with a friction generating means, for instance leaf springs, constantly pressing the web against the support.

In still another aspect of the invention, relating to delivery of the continuous web after successive definite lengths of it are processed and driven forward at the processing station, the apparatus further comprises means engaging the web at a location spaced downstream from the processing station for advancing the web there only when the downstream web lead is slack.

Still further, the apparatus is provided with means operative upon each driving forward of a web length from the processing station for folding the web delivered from the web advancing means so as to dispose the successive processed web lengths one upon another. Thus, for instance, when processing computer printout paper fed from a zig-zag folded pack, the successive sections between fold lines of the paper are re-folded into a compact stack as they are delivered from the web advancing means acting on the web lead downstream from the processing station.

Figure 2:
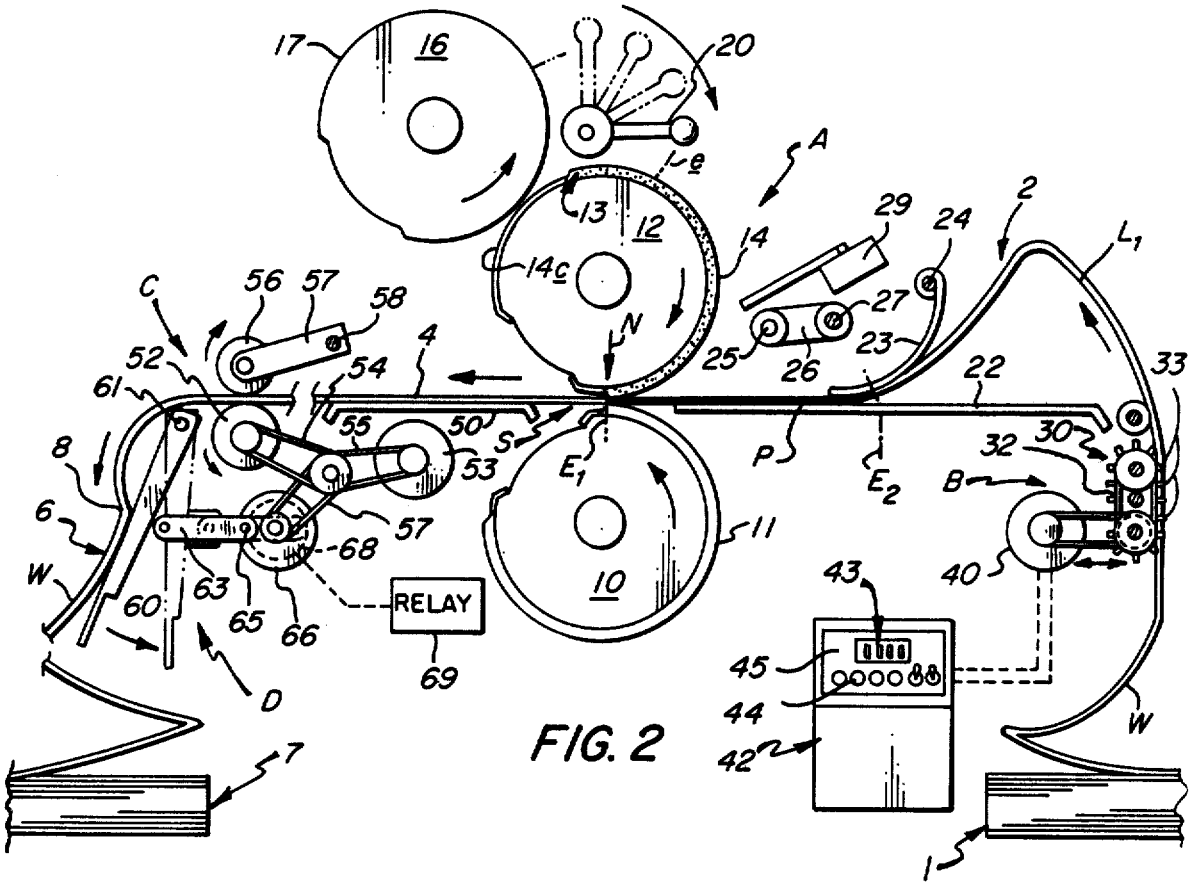
Figure 3:
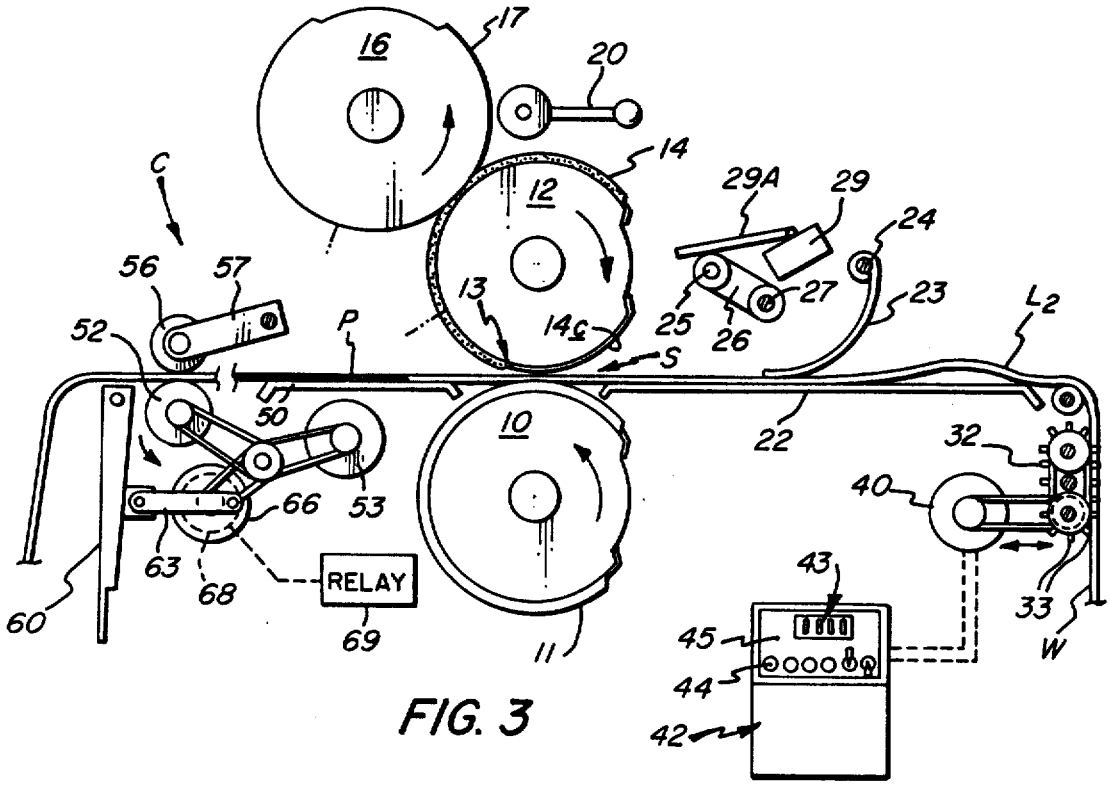
Figure 4:
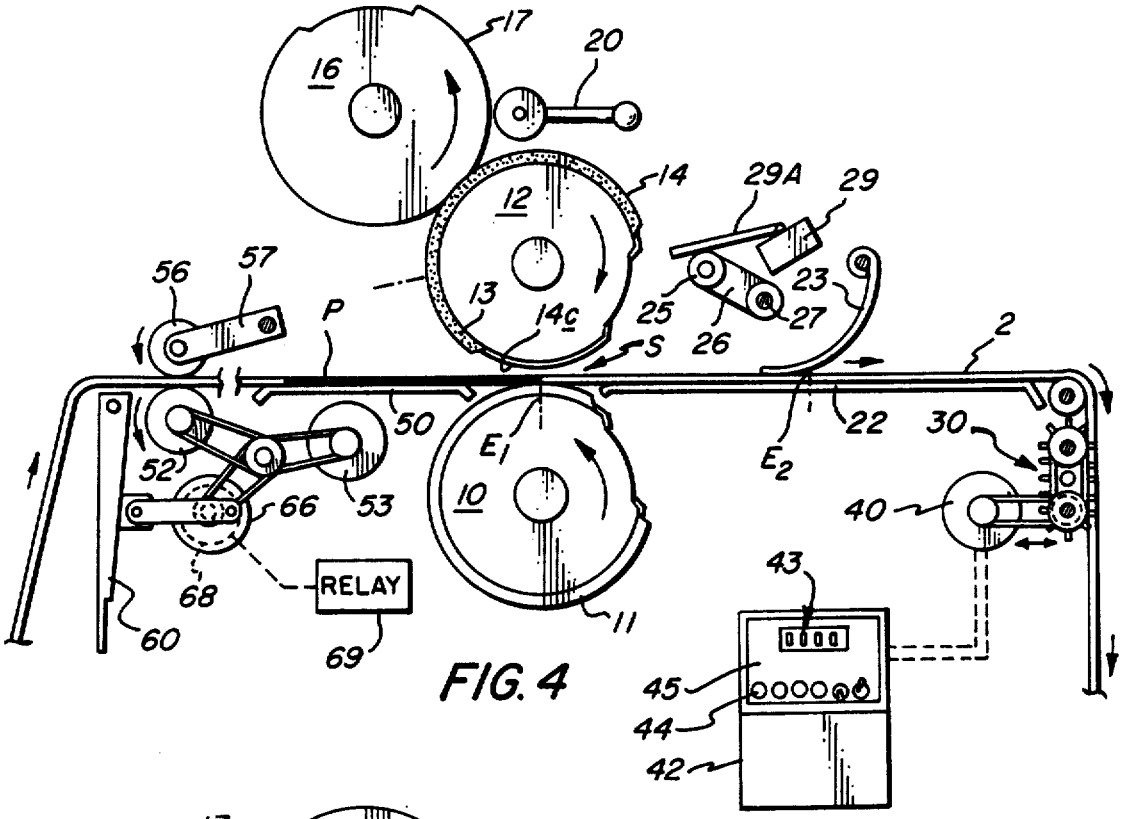
Figure 5:
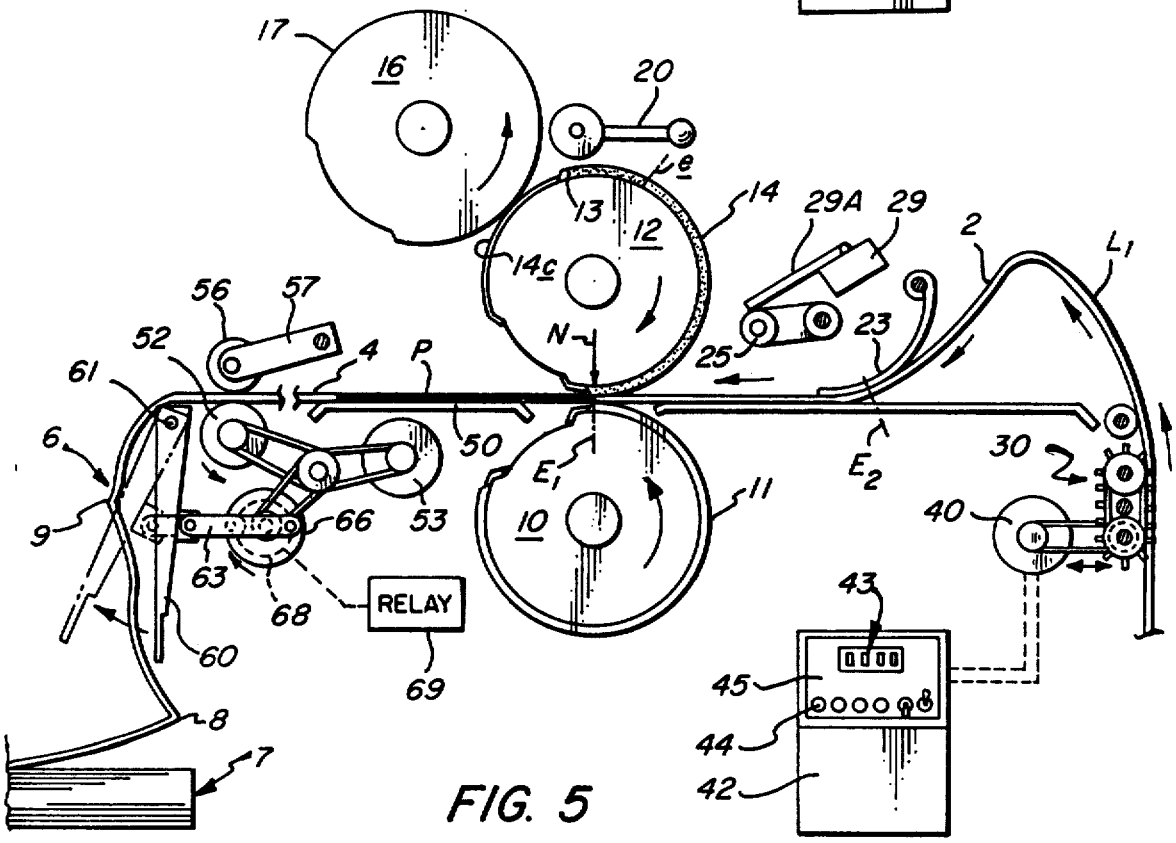
Figure 6:
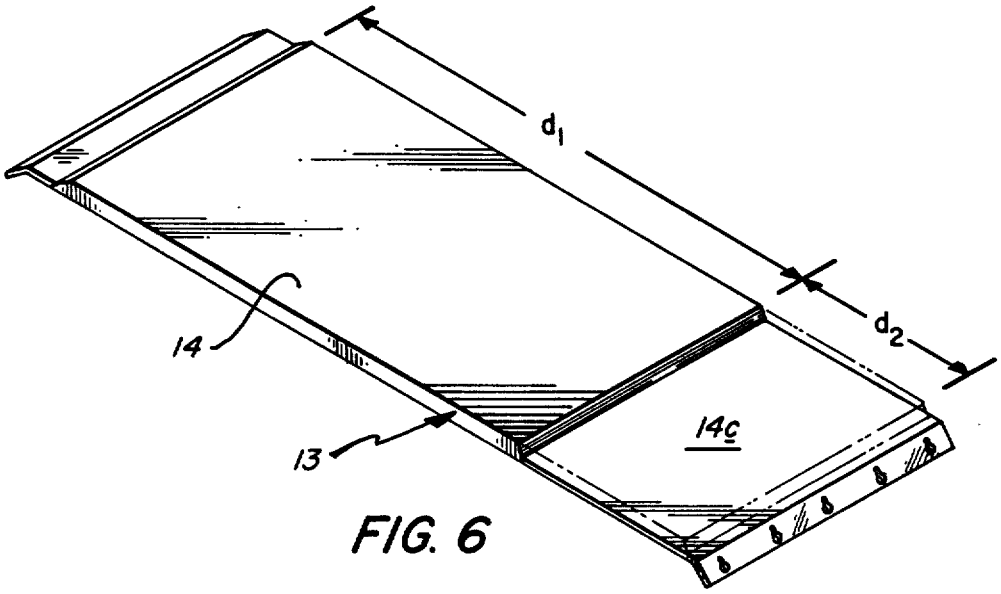
Figure 7:
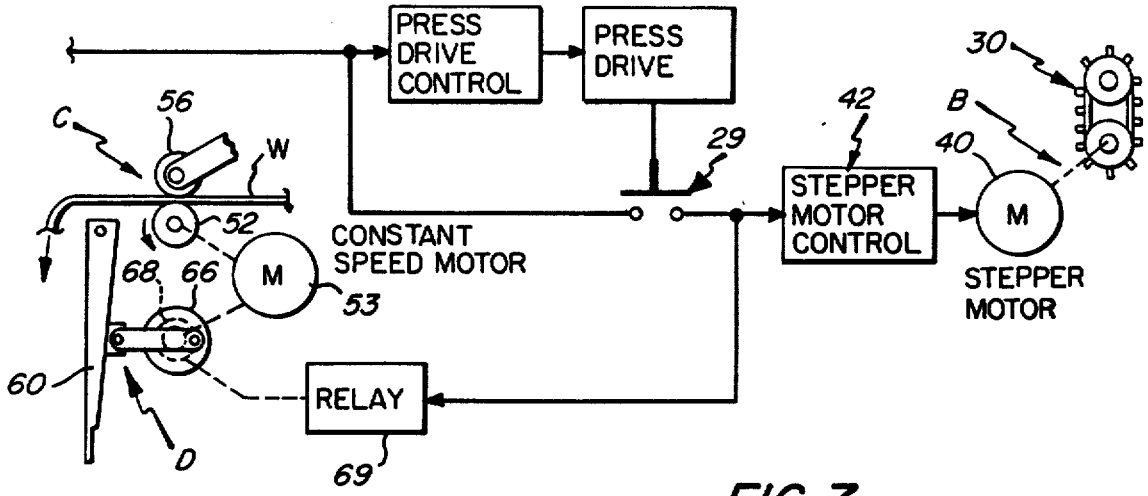

The above mentioned and other objects, features and advantages of the invention will be further evident from the following detailed description and the accompanying drawings of a preferred embodiment of the invention. In the drawings:

FIG. 1 is a perspective view of an apparatus embodying the invention, in which a conventional sheet fed rotary offset printing press is adapted to serve for processing the successive definite lengths of a continuous flexible web such as tractor fed computer printout paper;

FIG. 2 schematically illustrates relationships which exist in the apparatus at the beginning of a web processing phase of an operating cycle;

FIG. 3 similarly illustrates relationships existing when a certain web length has been processed and driven forward from between the press cylinders;

FIG. 4 similarly illustrates relationships existing when the web has been drawn backward by reverse operation of the web feeding means;

FIG. 5 similarly illustrates relationships existing when an excess web length has been fed into the upstream web lead and the next certain length of the web is about to be processed and driven forward between the press cylinders;

FIG. 6 is a perspective view schematically illustrating a blanket for use on the image transferring cylinder of the press, as cut away from one of the blanket ends to provide a desired length of peripheral surface for engagement with the underlying impression cylinder of the press; and FIG. 7 is a schematic diagram of a control circuit for coordinating operations of the web feeding means and the web refolding means with a phase of each cycle of operation of the press.

In the illustrated embodiment of the invention, successive equal lengths of a continuous paper web W, such as the sheet sections between fold lines of a computer printout paper drawn from a zig-zag folded supply of the paper in pack 1, are processed by being printed one after another in and driven forward from a modification A of a conventional sheet fed rotary offset printing press. A web feeding unit B is arranged for feeding the web into and drawing web back from a web lead 2 extending upstream from the press. A web delivery unit C acts on lead 4 extending downstream from the press. The web as delivered from unit C falls freely in a loose lead 6 along the location of a web re-folding unit D which acts on the successive processed web lengths to fold them each upon another into a processed paper pack 7.

The illustrated press A corresponds basically, but with modifications as hereinafter described, to a commercial offset duplicator identified as a Ryobi offset press No. 2800 CD, or as Itek duplicator No. 950/960 of Itek Corporation, Rochester, N.Y. The press includes an impression cylinder 10 and a coacting image transfer or blanket cylinder 12. A blanket 13 affixed to cylinder 12 has a peripheral surface portion 14 which, during a processing phase of each rotation of the cylinders, forms a paper imprinting and driving nip N by bearing against and turning with the peripheral surface 11 of the impression cylinder 10. A plate cylinder 16 has a planographic printing surface 17 for forming an ink image and transferring it to the surface 14 of cylinder 12. Conventional watering and inking roller systems, including a watering roller 18 and an inking roller 19, apply films of water and ink to the planographic printing surface 17, thus forming an ink image to be transferred via the blanket surface 14 to material engaged and being driven forward in the nip N.

A first modification incorporated in the press A consists in that the usual structures for holding and feeding sheets from a stack at the mouth of the press have been removed and a plate 22 is provided there for slidably supporting a continuous web W entrained through the processing station S. Also, a series of leaf springs 23 is arranged to extend downward from a supporting rod 24 and press the web constantly against the plate 22. The pressure applied by these springs produces a friction preventing casual displacement of the web yet enabling the web to move under little tension when either driven forward in the nip between cylinders 10 and 12 or drawn backward by the feeding unit B.

A second modification is that a rocking "sucker bar" 25 of the sheet fed press, which is rocked up and down by arms 26 on shaft 27 in each rotation of the cylinders 10 and 12, thus originally serving to lift a sheet and move it into the printing nip, has its sheet sucking tubes 28 (FIG. 1) removed and is utilized for opening and closing a microswitch 29 connected in a circuit (e.g. FIG. 7) controlling activations of the web feeding unit B and the web refolding D. The microswitch 29 thus is a triggering means through which the units B and D can be activated in proper coordination with the web driving and web disengaged phases of each rotation of the press cylinders 10 and 12.

A third modification consists in that the working surface 14 of the image transfer cylinder 12, instead of extending as usual from end to end of the blanket 13, is cut away along a sector 14c extending from one of the ends, to a distance as indicated by line $d_2$ in FIG. 6. This leaves surface 14 with a working length $d_1$ suited for driving a desired maximum length of the web forward through the nip N by coaction with the impression cylinder surface 11, and it increases by distance $d_2$ the length of the phase of each operating cycle in which the cylinders do not engage against the web in the processing station. Thus, a considerably increased portion of each cycle is provided for a non-driving phase of the press operations, within which the web retracting and web feeding operations of the feeding unit B can be effected in accordance with the present invention.

The illustrated web feeding unit B comprises a tractional web drive 30 arranged to be driven by a reversible stepper motor 40 which is activated and deactivated periodically through a stepper motor control system indicated diagramatically at 42. The drive 30 may be, for example, a commercial Model 886 tractor drive produced by Precision Handling Devices, Inc., of Assonet, Mass. It includes endless belts 32 at the opposite sides of a path for the web W, with pins 33 protruding from the belts to fit into series of perforations 34 spaced apart longitudinally in marginal strips of the web. The pins 33 precisely position the web when a web portion 35 is fitted onto them and clamped in place by swingable web clamps 36.

The stepper motor 40 may be, for example, a product of Digital Motor Incorporated identified as Stepper Motor No. HY 200-3437-400-A8. The motor controller 42 may be, for example, a commercial digital driver identified as a DCI Stepper Motor Controller With Power Supply. The controller includes programming input devices and related adjusting means which are settable easily, as by moving thumb wheels at 43 on a control panel 44, to determine precisely, for example to an accuracy of 1/160th of an inch, the respective distances of the drawing backward and the forward feeding of the web W by the drive 30 in each period of activation of the web feeding unit B.

At the downstream or web-delivery side of the press A, the lead 4 of the web W extends from the processing station S over a support plate 50 and then over a roller element 52 of the web delivery unit C. Roller 52 is driven continuously at constant speed by a motor 53, such, for example, as a constant speed gear motor, as by being connected through pulleys and belts 54 and 55 with the shaft of this motor. The roller 52, however, engages slippably with the web and exerts only a slight driving friction on it. The degree of this friction is determined by the pressure of freely rotatable rollers 56 which are loosely mounted, as on arms 57 freely swingable about the axis of a support rod 58, so that their weight holds the web pressed lightly against the surface of roller 52. As a result, the web W is advanced through unit C by the driven roller 52 only when slack web is present in the downstream lead.

The tension exerted on the web by the slippable driving action of unit C is so slight that it can neither tear the web nor move the web forward against the friction exerted by the leaf springs 23, nor impede a drawing backward of web by the feeding unit B. Consequently, no advance movement of the web through the processing station occurs in the web-disengaged phase of a press operatinq cycle; yet web is delivered through unit C whenever a web length is driven forward by the press, due to the downstream web lead 4 then becoming slack.

As lengths of the web are delivered from unit C, the loose web lead 6 falls correspondingly down and away from this unit so that sections of the delivered web can then be refolded into a processed paper pack 7. Operation of the web refolding unit D then serves effectively for refolding successive sections of the web one upon another.

The refolding unit D comprises a gate 60 having its upper end pivoted to a frame bracket 62 (FIG. 1) so that the gate hangs down along the path of fall of the loose web lead 6 and is swingable forward and backward about a horizontal axis at pivot 61. Swinging of the gate 60 is effected by a reciprocable bar 63 pivotally connected at 64 to a midportion of the gate. The bar 63 and gate 60 are thrust forward in one cycle of operation of the press A, and thrust backward in the next cycle. Thus, for instance, when a web section trailed by a backward fold line 8 is positioned to move down along the gate 60, as indicated in FIG. 2, backward movement of the gate lets that web section fall into place on the pack 7; while when a web section trailed by a forward fold line 9 is so positioned, as indicated in FIG. 5, forward movement of the gate guides that section down onto the pack 7.

The movements of the gate 60 in coordination with the successive cycles of the press can be effected in various ways. In the illustrated embodiment of the invention, the bar 63 has its backward end connected to a pivot 65 fixed eccentrically on a wheel 66 so that successive half rotations of this wheel effect the backward and forward movements of the gate. The wheel 66 is driven from the constant speed motor 53 via belts 55 and 67 and an electromagnetic clutch 68 that effects a half-revolution of the wheel when the clutch is activated. A suitable clutch, for example, is a 2-step Warner Clutch identified as Part No. 304-27-015 of Warner Electric Company. The clutch 68 in turn is activated through a relay 69 which is connected in the control circuit of the apparatus, as in a circuit controlled by the microswitch 29, so that a half revolution of the wheel 66 with a backward or forward movement of the gate 60 will be effected in each cycle of operation of the press A.

As is usual for a sheet fed press, a hand lever 20 and related mechanisms (not shown) enable an operator to select any of several conditions of the press. In the upright position of lever 20, the press is idle. A first turn of the lever (see FIG. 2) activates the watering rollers. A second turn activates the inking rollers to form an ink image on the plate cylinder 16 for transfer to the blanket cylinder surface 14. A third turn, to the position indicated by full lines in FIG. 2, puts the press in full operation with the cylinders "on impression" and driven so that, in each cycle of the operations, the sucker bar 25 is rocked to activate via microswitch 29 the controls for operation of the web feeding unit B and the refolding unit D, and then a length of the web W positioned in the processing station S is engaged, driven forward and printed in the nip formed by the cylinder surfaces 11 and 14.

A manner of carrying out the invention by use of the illustrated embodiment will now be explained further with reference to the schematic views in FIGS. 2, 3, 4 and 5 of the drawings.

To prepare the press A for operation, with its control lever 20 in the upright or press inactive position, a lead of the web W is pulled away from pack 1 and over the web feeding unit B and is threaded forward through the processing station S and then between rollers 52 and 56 of the web delivery unit C so as to hang down along the refolding gate 60.

A portion of the web near the feeding unit is then pulled back to bring a certain web length to a position for being processed, e.g., so that a fold line between web sheet sections will lie at the location of nip N in the processing station. Then the web portion at unit B is fitted onto pins of the tractor drive 30 and clamped in place. If this initial web placement is found not sufficiently precise when the press is running, any register error can be corrected by simple adjustment of unit B via the stepper motor controller 42; for instance, push button 44 on a control panel 45 can be pushed to effect incremental forward or backward web displacements of 1/160th inch each. Thenceforth, all displacements of the web away from or back toward the web supply in pack 1 are normally effected by the tractor drive 30 under the control of the stepper motor 40 and its controller 42 when they are activated via the microswitch 29.

The apparatus now is readied for operation. Movement of the hand lever 20 to its "on impression" position then causes the cylinders 10 and 12 to be driven and bar 25 to be rocked so that the arm 29A of switch 29 is moved to activate the web feeding unit. This results first in the stepper motor driving the web drive 30 a certain distance backward, thus drawing the web backward from lead 2 so that, as indicated in FIG. 4, the web now extends without slack from drive 30 through the processing station with the leading edge E1 of a web length E1–E2 to be processed positioned in register at the nip location of the cylinders.

Immediately afterward, the stepper motor controller causes the motor 40 and drive 30 to feed the web forward a certain measured distance. This feeding delivers into the upstream web lead 2 a loose excess length of web longer than the length that will be driven forward from the nip between the cylinders 10 and 12 in the web driving and processing phase of their rotation. When processing somewhat stiff flexible sheet material such as paper, a free upstanding loop L1 results in the upstream web lead 2 between the drive 30 and the web pressing region of the springs 23.

The press cylinders now reach the phase of their cycle in which surfaces 11 and 14 meet at nip N to drive the web forward and apply an image onto a web length P in position to be processed, as indicated in FIG. 2. In a typical example, that web length is a web section E1–E2 of 11 inches in length, and the blanket surface 14 has been cut back, for example, to 14 inches in length. For printing on the 11-inch web length P, cylinder 12 will carry an image on a portion of surface 14 extending from the leading edge (shown at the nip N in FIG. 2) to an end point indicated by line e. The portion of surface 14 trailing that end point will continue driving web forward but, in this example, without otherwise processing the web.

It results then in the web processing and driving phase of the cycle that 14 inches of web trailing the leading edge E1 is driven forward from the processing station, with an 11-inch web length P (indicated by dark shading) processed and advanced 3 inches beyond the location of nip N, as indicated in FIG. 3. All the web driven forward from the press in the cycle has been driven out of the loose excess web previously fed into the loop L1, yet an excess of loose web, ¾ inch long in this example, is still left in the upstream lead 2, as indicated at L2 in FIG. 3.

The press cylinders now reach the web-disengaged phase of a next operating cycle, with the bar 25 again being rocked to move the microswitch arm 29A and initiate another period of operation of the stepper motor system coupled with the web drive 30. In this period, the web is again drawn backward a certain distance from lead 2 by the backward drive of the web feeding unit. This distance in the stated example is 3¾ inches. The residual loose web L2 thus is drawn out of lead 2 and web is retracted through the processing station so that the trailing edge of the processed web length P is positioned at the nip location and becomes the leading edge of the next web length E1–E2 to be processed (FIG. 4). Then the web drive 30 feeds another 14¾ inches of excess web into the upstream lead 2 in readiness for the processing phase of the new cycle.

In the described practice of the invention, all the operations on the web are achieved with nearly tensionless transport of the web. The web is never pulled completely taut so as to risk being broken or torn. All longitudinal displacements of the web are effected from slack leads of it, with tension in the web only as required for moving it through a hold region such as that produced by the leaf springs 23 pressing on support 22.

As a result of the nearly tensionless transport of the web and the cyclical phase coordination of the web feeding and the web processing operations, the respective speeds of those operations are not interdependent; importantly increased speeds of the press operations can be achieved; and changes of the speed or other operating conditions of the press can be effected without need for adjustment of the operating conditions at the web feeding unit, and vice versa. The web feeding system works the same whether the press is running fast or slow.

Advantages are realized similarly at the downstream or web delivery side of the press. The processed web driven forward from the press in each operating cycle can of course be delivered or collected in various ways. It is advantageous, however, particularly when processing a sheet material such as zig-zag folded computer printout paper, to deliver and collect the web by a system such as that provided by the web delivery unit C and the refolding unit D.

By virtue of that system, processed web is delivered away from the press by the delivery unit C whenever the web driving phase of a press operating cycle creates slack in the downstream web lead 4. The refolding unit is activated once in each press cycle, so upon each web driving by the press, to fold a web length being delivered correspondingly down along the gate 60. For instance, the actuation of switch 29 in the first press operating cycle mentioned above has energized relay 69 and caused the gate 60 to be swung backward as web length P is driven forward (FIG. 2), and the switch actuation in the next cycle causes the gate to be swung forward as the next web length E1–E2 is driven forward (FIG. 5). Being operated in coordination with the web driving phases of the press cycles and independently of the press operating speed, the refolding unit requires no adjustment when the speed of the press is changed. Further, this unit can serve effectively for folding web sections having different lengths. Basically, it needs only to be activated and deactivated at a certain stage in each cycle of the press operations.

If in the illustrated embodiment the length of the web sections to be processed is different from 11 inches, say 13 inches, all the operator needs to do is adjust the stepper motor controller 42, as by resetting its thumb wheels 43, so that the length of web drawn back from the upstream lead 2 by web drive 30 in the web-disengaged phase of each press cycle will be 1¾ inches instead of 3¾ inches. With 14¾ inches of loose web fed forward into lead 2 in each cycle and 14 inches of that web driven forward by the press, the web retraction of 1¾ inches removes the residual ¾ inches of slack (loop L2) and retracts the web in processing station S to a net forward driven length of 13 inches. Other changes of the web length processed in each cycle can be effected similarly, within the web driving capacity of the surface 14 provided on the blanket 13 of cylinder 12.

The foregoing detailed description and the drawings are illustrative of a presently preferred manner of carrying out the invention. Many other ways and means can be employed, however, for carrying out and achieving advantages of this invention. For instance: A web processing machine can be designed and made for such purpose, instead of being provided by modifications of and attachments to an existing or a conventional machine or press. The web feeding operations can be effected by any of various non-slipping web driving systems, and can be controlled in ways or by means other than those described. Flexible sheet materials of various kinds can be processed in continuous web form. The web processing phase of a press operating cycle need not be simultaneous with the web driving phase, but can occur before or after the web is driven forward by the press.

The invention therefore is not to be considered limited to particulars described or illustrated in the drawings except as may be required for fair interpretation of the appended claims.

I claim:

1. A method of processing one after another definite lengths of a continuous flexible web extended from a supply thereof into a processing station, comprising:

(a) feeding into a lead of the web upstream from said station an excess length of the web longer than a certain web length positioned to be processed in said station;

(b) then processing said certain web length in said station and driving forward from said station and out of said lead a length of the web at least as long as said certain web length but shorter than said excess length, thus leaving slack web in said upstream lead;

(c) then drawing the web backward from said lead so as to retract the slack web therefrom and leave positioned in said station a next certain web length to be processed;

and then repeating steps (a), (b) and (c).

2. A method according to claim 1, said drawing backward being of a length of the web equal to the difference between said certain web length and said excess web length.

3. A method according to claim 1 or 2, said forward driven length of the web being longer than said certain web length, said drawing backward being of web longer than the slack web left in said lead and being effected in part with movement of the web backward through said processing station to position therein a next certain web length to be processed.

4. A method of processing one after another definite lengths of a continuous flexible web extended from a supply thereof into a processing station, comprising, for each web length positioned in said station to be processed:

(a) feeding toward said station so as to form a loose web loop upstream therefrom an excess length of the web longer than the web length to be processed;

(b) processing the positioned web length in said station and driving forward from said station and out of said loop a length of the web at least as long as the processed web length but shorter than said excess web length;

(c) and then retracting upstream of the remaining slack web of said loop a length of the web equal to the difference between the processed web length and said excess web length.

5. A method according to claim 4, said processing being effected simultaneously with said driving forward of the web.

6. A method according to claim 4 or 5, said forward driven length of the web being longer than said processed web length, said retracting being of a length of the web longer than the remaining slack web of said loop and being effected in part with movement of the web backward through said processing station to position therein a next web length to be processed.

7. A method of processing one after another lengths of a continuous flexible web extending into a processing station wherein a rotary processing means that does not engage against the web in one phase of a complete rotation of said means will process a certain length of the web in a second phase of the rotation, said method comprising:

(a) in said one phase of a said rotation, drawing the web backward from a lead of the web upstream from said station so as to remove slack web from said lead and leave a certain web length positioned in said station to register with said processing means;

(b) then feeding into said upstream lead a length of the web longer than said certain web length, thus forming a looped upstream lead of the web;

(c) during said second phase of the rotation, processing said certain web length and driving forward from said station and out of said looped lead a length of the web longer than said certain web length but shorter than the web length fed into said lead, thus leaving slack web in said lead;

(d) and then repeating steps (a), (b) and (c).

8. A method according to claim 7, said drawing backward being of web longer than the slack web left in said lead and being effected in part with movement of the web backward through said processing station to position therein a next web length to be processed.

9. A method according to claim 7 or 8, and applying to a portion of said upstream lead at a location near said station a pressure sufficient to resist displacement of the web there otherwise than by a said drawing backward or a said driving forward.

10. An apparatus for processing successive definite lengths of a continuous flexible web extended from a supply thereof through a processing station, comprising:

at said station continuously cyclically operable web processing and web driving means which in one phase of a cycle of their operation do not operatively engage the web and in a second phase of the cycle will process a certain length of the web, drive the web forward a certain distance at least as long as said certain web length, and then disengage from the web;

web feeding means engaging the web at a location spaced upstream from said station and operable periodically to draw a measured length of web backward from the web lead extending from said feeding means into said station, and then to feed forward into said lead a measured excess length of web longer than said distance of forward drive of said certain web length from said station;

and means for activating said feeding means in said one phase of each said cycle of operation so that the drawing backward of web will remove slack from said web lead and leave a certain web length positioned to be processed in said station and, in said second phase of the cycle, the driving forward of said certain web length will leave the web slack in said web lead.

11. Apparatus according to claim 10, said web feeding means being operative to draw backward a length of web corresponding to the difference between said excess length and said certain web length.

12. Apparatus according to claim 10, said activating means comprising switch means connected with means for controlling said web feeding means, and means moved in coordination with each cycle of operation of said web driving means for actuating said switch means at a certain stage in each said cycle.

13. Apparatus according to claim 10, 11 or 12, said web feeding means comprising web drive means nonslippably engaging the web and a reversible stepper motor for driving said web drive means; said activating means comprising stepper motor control means; and means for adjusting said control means to set precisely the respective distances of the drawing backward and the feeding forward of the web in each period of operation of said motor.

14. Apparatus according to claim 10, 11 or 12, further comprising means for exerting on said web lead at a location near said station a friction sufficient to resist displacement of the web there otherwise than by said web driving means or said web feeding means.

15. Apparatus according to claim 14, said friction exerting means including a support over which the web is slidable to said station and leaf springs constantly pressing the web against said support.

16. Apparatus according to claim 10, 11 or 12, further comprising means engaging said web at a location spaced downstream from said processing station for advancing the web there only when the downstream web lead is slack.

17. Apparatus according to claim 16, said web advancing means comprising constantly driven roller means operative slippably to draw the web forward by a friction enabling only slight driving tension on the web.

18. Apparatus according to claim 17, further comprising means for applying constantly to said upstream web lead at a location near said station a pressure preventing displacement of the web there by said roller means.

19. Apparatus according to claim 16, further comprising means operative upon each driving forward of a said web length from said station for folding the web delivered from said web advancing means so as to dispose the successive processed web lengths one upon another.

20. Apparatus according to claim 19, said folding means comprising a gate swingable about a horizontal axis and depending from said axis along the path of a loose lead of the web falling away from said web advancing means, and means for swinging said gate alternatively forward and backward in coordination with successive cycles of operation of said web driving means.

21. Apparatus according to claim 20, said gate swinging means comprising a reciprocable bar having an end portion pivotally connected with said gate, means for thrusting said bar forward in one said cycle and backward in the next said cycle, and control means including switch means actuated in coordination with movement of said web driving means for activating said bar thrusting means in each of said cycles.

22. Apparatus whereby a rotary press for processing separate sheets one after another is adapted for processing successive definite lengths of a continuous flexible sheet material, said press including continuously rotatable cylinders which in one phase of each rotation thereof are peripherally spaced apart and in a second phase of the rotation meet peripherally in a nip to drive forward and process a length of sheet material disposed between them, said apparatus comprising:

at least one of said cylinders having a peripheral sector thereof recessed so that, in said one phase of a rotation thereof said sheet material is free to be positioned between the cylinders and in said second phase of the rotation the material will be engaged in said nip and driven forward a certain distance greater than the length of the material to be processed by a rotation of the cylinders; and feeding means non-slippably engaging the sheet material at a location spaced upstream from said cylinders, said feeding means being operative in said one phase of each said rotation (1) to draw a measured length of the material backward from a lead of the material extending from said feeding means into the press so that slack is removed from said lead and a certain length of the material is positioned to be driven forward and processed in said nip, and then (2) to feed forward into said lead a measured excess length of the material longer than said certain distance of forward drive of the material, so that the driving forward and processing of the material in said second phase of the rotation leaves slack material in said lead.

23. Apparatus according to claim 22, said feeding means being operative in said one phase of each said rotation to draw backward from said lead a length of the sheet material equal to the difference between said excess length and said certain length of the material.

24. Apparatus according to claim 23, further comprising means for adjusting said length of the material drawn backward by said feeding means and thereby changing the certain length of the material next to be driven forward and processed in said nip.

25. Apparatus according to claim 22, wherein said press further includes a bar rocked in coordination with each rotation of said cylinders, and control means including a switch actuated in response to a movement of said bar for activating said feeding means in said one phase of each said rotation.

26. Apparatus according to claim 22, wherein said press is an offset duplicating press adapted for printing the successive sections between fold lines of a zig-zag folded paper web, such as computer printout paper, formed longitudinally with perforations to be engaged and driven by pins of a tractional web driving means;

said feeding means comprising a said tractional driving means engaged with a portion of a said web extended from a supply of zig-zag folded sections of the web through the nip location of said cylinders and a reversible stepper motor for driving said tractional device;

and control means for adjusting and controlling the operations of said motor, said control means including means for setting precisely the respective distances of drawing backward and feeding forward of said web in each period of operation of said motor.

27. Apparatus according to claim 26, further comprising:

at a location spaced downstream from said cylinders, constantly driven roller means operative slippably to draw said web forward from a downstream lead thereof by a friction enabling only slight driving tension on the web;

means for exerting on said upstream web lead at a location near said station a friction preventing displacement of the web there by said roller means;

and means operable in coordination with said second phase of each rotation of said cylinders for displacing loose web delivered from said roller means so as to refold the successive sections thereof zig-zag one upon another.

28. Apparatus according to claim 22, 23, 24, 25, 26, or 27, said cylinders comprising an impression cylinder and a coacting cylinder for carrying a transferable image to sheet material being driven forward in said nip; said coacting cylinder having thereon a blanket the surface of which is cut away a certain distance extending from one of its ends to provide between the remaining blanket surface and the impression cylinder said certain distance of engagement and driving forward of the material.

* * * * *